US006601757B2

(12) United States Patent
Bowman

(10) Patent No.: US 6,601,757 B2
(45) Date of Patent: Aug. 5, 2003

(54) INTEGRATED RIGID SET UP GIFT BOX

(75) Inventor: Lindy Bowman, Ellicott City, MD (US)

(73) Assignee: The Lindy Bowman Co.,, Ellicott City, MD (US)

( * ) Notice: Subject to any disclaimer, the term of this patent is extended or adjusted under 35 U.S.C. 154(b) by 0 days.

(21) Appl. No.: 09/885,528

(22) Filed: Jun. 21, 2001

(65) Prior Publication Data

US 2002/0195481 A1 Dec. 26, 2002

(51) Int. Cl.[7] ..... B65D 5/42; B65D 5/68

(52) U.S. Cl. ..... 229/116.5; 229/125.22; 229/922

(58) Field of Search ..... 229/116.5, 125.19, 229/125.22, 125.38, 922, 923; 206/457, 459.5

(56) References Cited

U.S. PATENT DOCUMENTS

| | | | | | |
|---|---|---|---|---|---|
| 581,051 | A | * | 4/1897 | Wolf | 229/125.22 |
| 655,019 | A | * | 7/1900 | Schmidt | 229/125.22 |
| 696,928 | A | * | 4/1902 | Beecher | 229/125.38 |
| 705,953 | A | * | 7/1902 | Neihysel | 229/125.38 |
| 963,313 | A | * | 7/1910 | Nack | 229/125.38 |
| 1,083,403 | A | * | 1/1914 | Joslin | 229/125.38 |
| 1,322,290 | A | * | 11/1919 | Cibulka | 229/125.38 |
| 1,323,335 | A | * | 12/1919 | Terwilliger, Jr. | 229/125.22 |
| 1,501,913 | A | * | 7/1924 | Morris | 229/125.22 |
| 1,523,130 | A | * | 1/1925 | Knoth, Jr. | 229/125.22 |
| 1,777,716 | A | * | 10/1930 | Case | 229/125.19 |
| 1,922,354 | A | * | 8/1933 | Burke | 229/125.22 |
| 2,453,920 | A | * | 11/1948 | Kysela | 229/922 |
| 2,771,237 | A | * | 11/1956 | Philipson | 229/125.22 |
| 4,726,509 | A | | 2/1988 | Fonas | |
| 5,452,846 | A | | 9/1995 | Myers | 229/116.3 |
| 5,584,429 | A | | 12/1996 | Savage | 229/103.3 |
| 5,765,748 | A | * | 6/1998 | Chen | 229/125.38 |
| 5,850,963 | A | | 12/1998 | Chang | 229/116.5 |

* cited by examiner

*Primary Examiner*—Gary E. Elkins
(74) *Attorney, Agent, or Firm*—Cahn & Samuels, LLP

(57) ABSTRACT

An integrated, pre-decorated, rigid set-up gift box including a ribbon, a lid, and a box container defining a ribbon channel in the floor thereof and ribbon feedthroughs to permit the lid to be tied to the box container with the ribbon to thereby form an integrated, coordinated gift package.

9 Claims, 3 Drawing Sheets

INTEGRATED RIGID SET UP GIFT BOX

FIELD OF THE INVENTION

The present invention relates to improvements in rigid set-up boxes used for gift packaging.

BACKGROUND OF THE INVENTION

Rigid set up gift boxes are used in connection with gift presentation and are commonly used. Most rigid set up boxes include a lid and a container and may bear the logo or name of the vending establishment. Typically, the gift giver selects a decorative gift wrap that is placed around the box and then the wrapped box is decorated with a ribbon, bow and the like. To achieve a neatly presented gift wrapped package requires skill, discipline, and patience, qualities rarer in some than others.

For the "wrapping challenged" the task of wrapping a pre-formed box of uniform dimensions still requires wrapping which can provide a less desirable appearance due to wrapping technique flaws. Therefore, the provision of a preformed, rigid box does not mitigate the challenge to the fumble-fingered gift wrapper.

Furthermore, the task of wrapping a box typically proves time consuming (selecting paper, sizing, cutting, folding and taping) and somewhat wasteful of resources (paper, tape, etc.). In times of high volume, gift purchasing, the prospect of taking the purchases home to wrap them adds to the stress of an already hectic shopping experience. To some challenged gift givers, the combination is almost unbearable.

Alternatives have appeared, for example, at peak gift giving times, e.g., the holiday season, a gift purchaser may turn for help to an available gift-wrap service. This act itself, may prove to be a challenge as the consumer/gift giver must contend with and negotiate long lines to avoid the gift wrapping plague. Recently, to assist consumers, rigid set up boxes incorporating coordinated designs corresponding to a desired motif (children's birthdays, Christmas, graduation, etc.) have become available. Such boxes facilitate time savings. However, unless secured, the lid of such a box may be dislodged from the underlying container to thereby expose the gift. Consequently, decorative gift boxes are often tied with a ribbon to secure the lid to the box container. Particularly in the case of a highly decorative, specialty box, the gift giver may forget to purchase a color-coordinated ribbon. Thus, even with a decorative gift box, the user may use a non-matching ribbon found in the user's abode.

SUMMARY OF THE INVENTION

It is an object of the present invention to provide a more attractive, efficient and decorative rigid set up gift box than that provided by prior art constructions.

It is a further object of this invention to provide a secure enclosure for gifts, while maintaining a decorative presentation.

It is another object of this invention to provide a gift-wrapping alternative that, at once, provides an aesthetic, appealing, and decorative presentation of a gift with a minimum of effort, waste, and complexity.

It is an object of this invention to provide an integrated gift box/ribbon combination that is at once time efficient and easily used.

It is another object of this invention to provide an attractive gift presentation, independent of the wrapping skill level of the gift giver.

Yet another object of this invention is to provide a sturdy, economical gift presentation, which retains decorative and structural integrity to thereby permit reuse.

These and other objects of the invention are satisfied by a rigid set up box featuring a lid, a box container, and a ribbon. The ribbon is formed of a thin flexible material of a selected width and length. The box container is defined by a floor defining a generally flat member having an upper and a lower surface, and having a perimeter. The flat member includes a generally planar base member extending under the entire floor and having at least two insert members of a select thickness which is greater than the ribbon width where said insert members are affixed to the planar base member in a manner to be separated and to define a first channel corresponding to the width of the ribbon and extending across the upper surface of the planar base member and defining a selected depth corresponding to the select thickness of the inserts. The box container includes an upstanding side wall portion having an interior and an exterior surface, said side wall portion projecting from the perimeter of the member and above the upper surface for a select distance. A pair of slotted ribbon throughputs is formed through the side wall a second select distance which is less than the select distance. The side wall portion may also include a pair of side wall channels disposed oppositely each other relative to the floor, where each of said side wall channels communicate the ribbon between the first channel and the slotted throughputs. The lid defines an upper surface and a lower surface corresponding to the generally planar base member combined with the upstanding side wall portion where the lid side wall portion depends a third distance which is less than the first select distance less the second select distance. Thus, the lid is adapted to seat over and on said box container where the ribbon is of a length sufficient to pass through the first channel, through the ribbon throughputs and over the upper surface of the lid to permit the ribbon to be secured over the lid to thereby secure the lid and box container together.

Still other objects of the invention are satisfied by a method of using the above-described rigid set up box including the steps of placing a select item in the box container, seating the lid onto the box container, and tying the ribbon over the top of the lid.

In a nutshell, the invention contemplates the combination of a lid, container, and ribbon, all formable into an integrated, coordinated, decorative structure that assures a very easily assembled, neat, attractively decorated gift presentation that coincidentally provides a heightened level of confidence that the gift package will remain closed until opened by the recipient. Aesthetically, the invention minimizes work and stress typically required to obtain a desirable finished product, for which the gift giver invests no more time than that required to choose the appropriately decorated and sized box and tie the ribbon over the lid. Thus, the instant invention satisfies the primary advantages of neatness, convenience, efficiency, and resource conservation.

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing, which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

DETAILED DESCRIPTION OF THE ILLUSTRATED EMBODIMENTS

Figure 1:
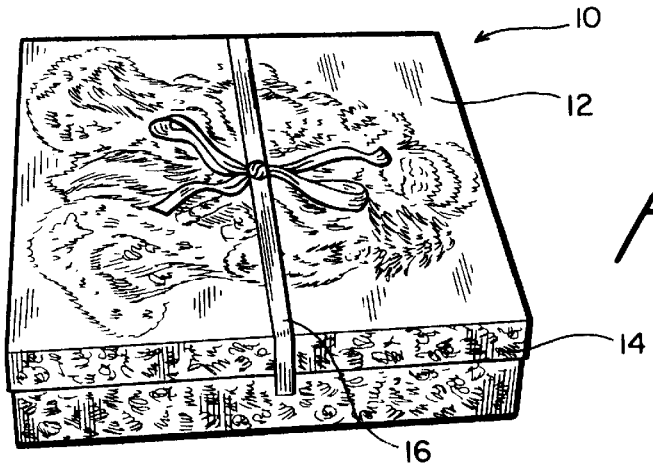
FIG. 1 is a perspective photographic representation of an integrated gift box/ribbon according to one embodiment of the invention.
Figure 2:
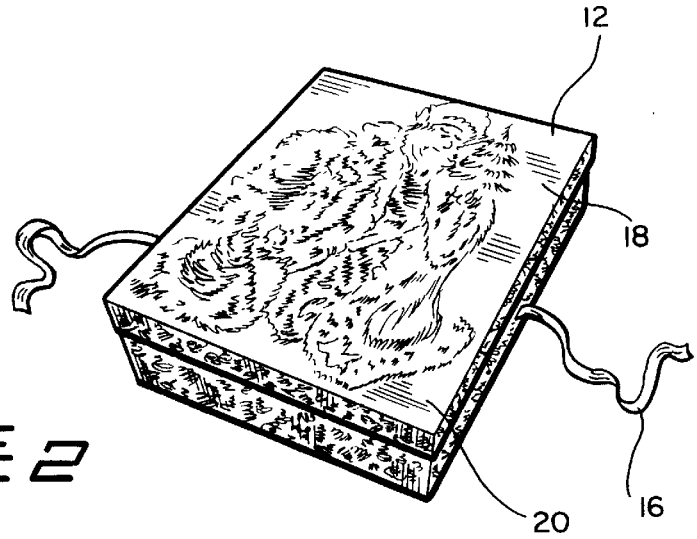
FIG. 2 is top perspective photographic view of the gift box/ribbon of the embodiment in FIG. 1.
Figure 3:
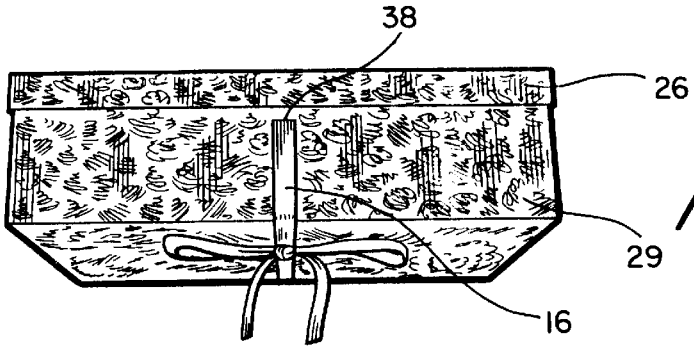
FIG. 3 is a side photographic view of the gift box/ribbon of the embodiment in FIG. 1.

Referring now to the figures and, in particular, to FIGS. 1 through 4 there is shown a rigid set up, rectangular gift box 10 in accordance with a first embodiment of the invention. The gift box 10 includes a lid 12, a box container 14, and a conventional satin ribbon 16. The lid 12 and box container 14 are formed from a relatively heavy 550 GMS (grams per meter squared) grey board paper. The inside surface of the box includes a laminated No. 80 wood free paper (non-glossy) and the exterior is covered with high gloss, printed No. 110 art paper.

The lid 12 corresponds to conventional structure. It includes a flat planar surface 18 formed of a cardboard core to which the preprinted exterior and interior decorative paper panels 20 and 22 are glued, respectively. The edges of the planar surface incorporate depending side walls (overlapping lips) 24 to which, at least the exterior surface has glued/laminated thereto a high gloss art paper 26 decoratively corresponding in color and texture to the exterior decorative panel 20. The combination of the stiff cardboard core and the high gloss exterior lend the structure to multiple uses as the lid will retain structural integrity and the high gloss surface will remain bright and may be subject to mild cleaning.

The construction of the box container 14 represents a unique structure. The box container 14 incorporates a rectangular base panel 28 and vertically disposed side walls 29. The base panel 28 is established by a combination of a cardboard floor 30 with a pair of cardboard inserts 32 glued thereon. The inserts 32 are sized to align with the floor edges, and preferably are glued to the upper (interior) surface of the floor and cover all of the floor except for a median ribbon communication channel 34 extending between a pair of oppositely positioned ribbon slots 36 formed corresponding to the channel ends. Preferably, the ribbon floor slots 36 are each located proximate to a base of facing side walls 29 and conform in width to that of the ribbon 16. Two side wall ribbon feedthrough slots 38 are formed in the side walls 29 at a distance below the upper wall edge corresponding to the length of the depending side walls 24. All of the slots 36 and 38 may be reinforced with a grommet but have been found to possess adequate tear strength based on the use of the interior-covering, printed No. 80 wood free paper comprising the panel 22.

The ribbon 16 of the invention is set in the channel 34 before the interior paper panel is glued onto the inserts 32. It has been determined that the channel area should be substantially glue free to permit free translation of the ribbon therethrough. Consequently, it is preferred to avoid adhesive application to any of the components within an inch on either side of the channel 34 to either the inserts 32 or the paper panel 22. By employing the above-described arrangement, each end of the ribbon extends from the channel 34 through the floor slots 36 into the box interior (40) and through the side wall slots 38. Upon placing the lid 12 on the box container 14, the ribbon 16 which projects from the container box at a point just below the edge of the lid side, is tied in a bow on the top of the lid to thereby establish the integrated rigid, decorative gift box 10 of the illustrated first embodiment of the invention.

Figure 5:
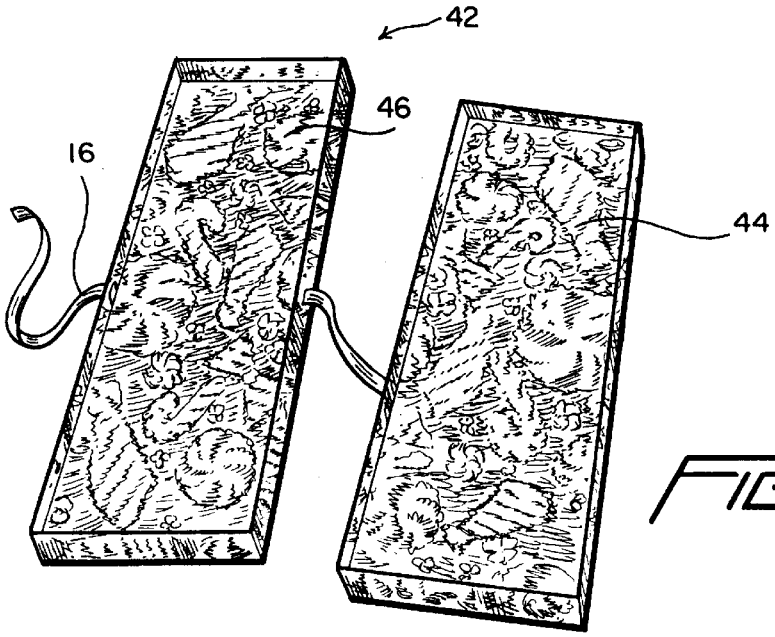
FIG. 5 is a top photographic assembly view of a second embodiment of an integrated gift box/ribbon of the invention.
Figure 4:
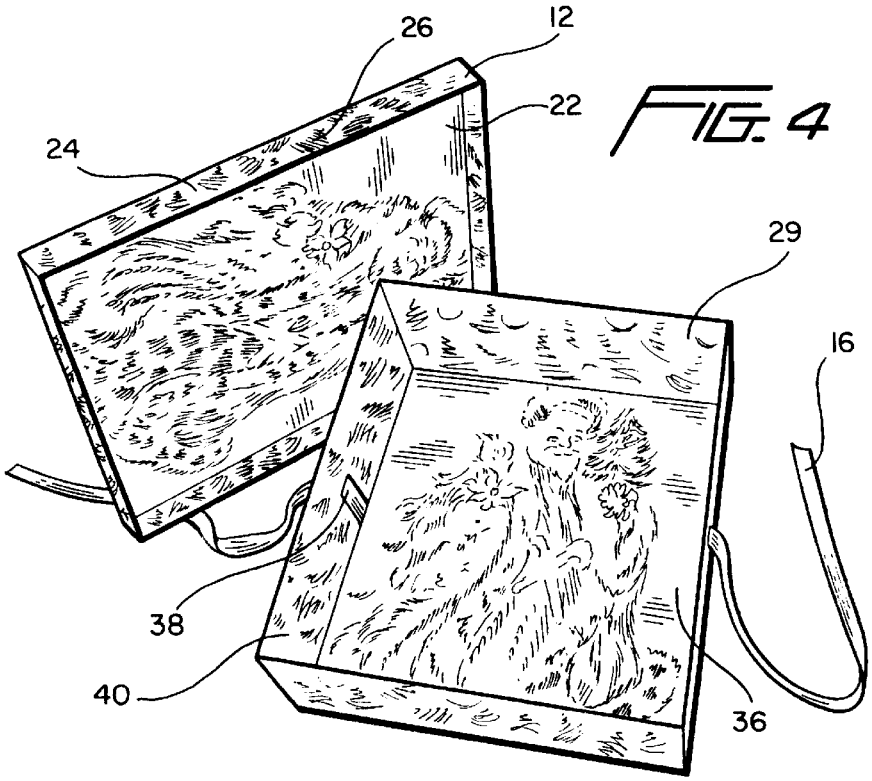
FIG. 4 is a component photographic view of the gift box/ribbon of the embodiment in FIG. 1.
Figure 6:
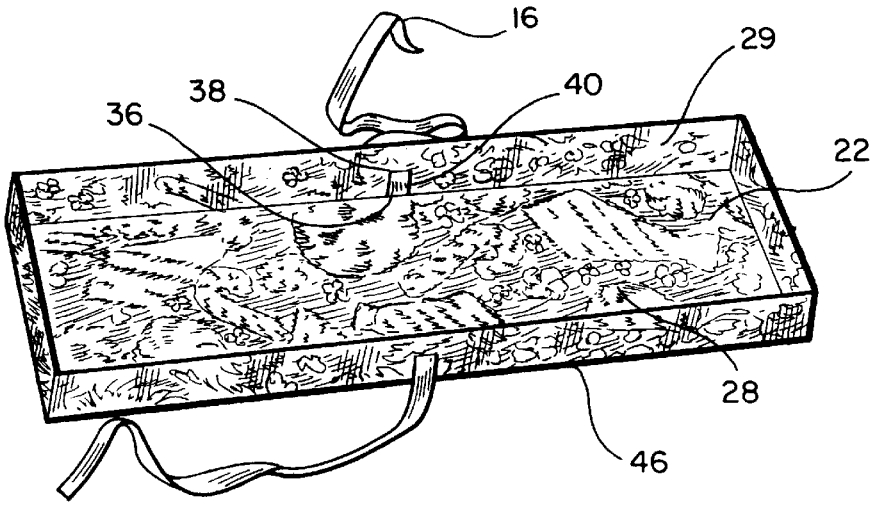
FIG. 6 is top photographic view of the gift box container of the embodiment in FIG. 5.
Figure 7:
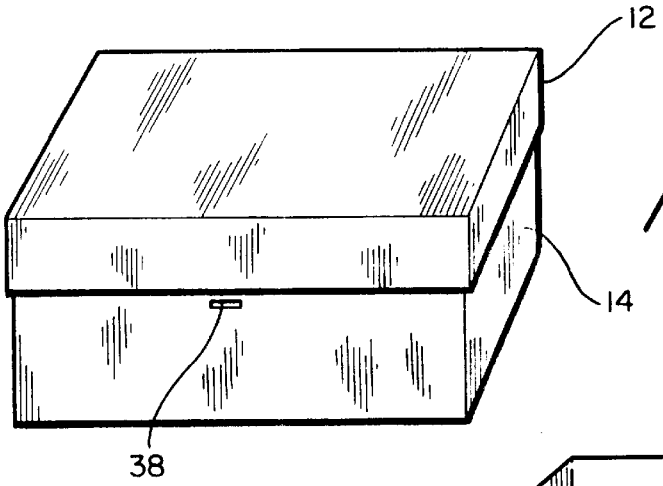
FIG. 7 is a diagrammatic representative depiction of a box container and lid in assembly.

A second embodiment of the invention, in the form of a tie-box 42, is depicted photographically in FIGS. 5 and 6. The tie box 42 includes a top 44 and a bottom 46. Other than differing in dimensions, the depicted tie box 42 possesses the same structural features described above. The decorative features differ in as much as a single pattern decorative cover paper is employed. As in the case of the first illustrated embodiment, the interior paper appears to be seamless, that is, laid down in a smooth, flawless manner. Hiding the presence of the underlying channel.

Figure 8:
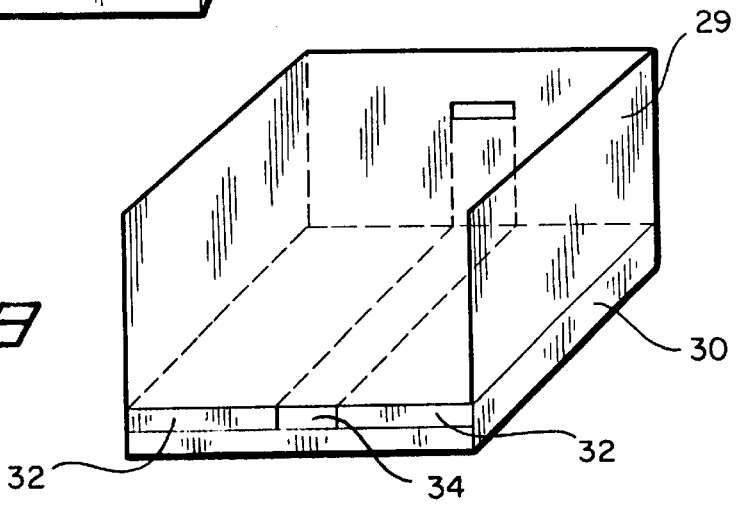
FIG. 8 is a cross-sectional view of a further embodiment of a rigid set up box according to the invention.

The third illustrated embodiment is represented in FIG. 8. In this figure, the side walls include matched cardboard inserts positionally corresponding to the floor inserts 32. The side wall inserts provide a ribbon channel 48 extending from the floor 28 to the ribbon feedthrough 38. To prevent the ribbon from damaging the paper at the interior box corner, a small reinforcing element (a plastic or metal thread, can be laid down transverse to the channel elbow and along the edge of the floor. It is intended that this further embodiment otherwise is in keeping with the descriptions provided above.

Although as illustrated in a rectangular configuration, the invention may be in any form capable of acting as a container, e.g., elliptical, hexagonal, round, polyhedral, etc. The illustrated embodiment also depicts an opaque lid. It is however, within the purview of the present invention to incorporate attractive design features such as Fresnel, uneven surfaced, and/or even translucent or transparent panels to enhance the decorative effect of the invention. Such enhanced features integrated in the lid panel should possess sufficient rigidity and strength to meet the structural integrity objectives of the instant invention.

Another variation to the illustrated embodiments is to expand on the number of ribbon channels and ribbons. The illustrated embodiments depict a single ribbon channel to accommodate a single ribbon in the floor of the container. It is within the scope of the invention to include a plurality of channels and integrated ribbon inserts where desired for utilitarian and aesthetic reasons. The disclosure suggests that the ribbon be tied. However, it is within the scope of this invention to include ribbon portions that are removably adherable to one another (reusable adhesive, Velcro®, etc.) and may include a detachable preformed bow that is coordinated (color, texture, etc.) with the integrated ribbon.

In order to improve the reusability of a rigid setup box in accordance with the invention, the ribbon may incorporate a flexible, reinforcing member such as wire to permit the ribbon to be smoothed out after use for subsequent uses.

Given the foregoing, it should be apparent that the specifically described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

I claim:

1. A rigid set up box comprising:

a lid, a box container, and a ribbon, where said ribbon is formed of a thin flexible material of a selected width and a length, where the box container is defined by a floor defining a generally flat member having an upper and a lower surface, said member having a perimeter, said member including a generally planar base member extending under the entire floor and having at least two insert members of a select thickness greater than the ribbon width where said insert members are affixed to the planar base member in a manner to be separated and to define a first channel corresponding to the width of the ribbon and extending across the upper surface of the planar base member and defining a selected depth corresponding to the select thickness of the inserts, an upstanding side wall portion having an interior and an exterior surface, said side wall portion projecting from the perimeter of the member and above the upper surface for a first select distance, a pair of side wall channels formed in said side wall portion and disposed oppositely each other relative to the floor, where each of said side wall channels terminate at a ribbon throughput including a ribbon opening formed in the exterior surface a second select distance less than the first select distance, where said lid defining an upper surface and a lower surface corresponding to generally planar base member combined with the upstanding side wall portion, said lid including a side wall portion defining a third distance less than the first select distance less the second select distance, said lid being adapted to seat over and on said box container, and where the ribbon is of a length sufficient to pass through the first channel, through the ribbon throughputs and over the upper surface of the lid to permit the ribbon to be secured over the lid to thereby secure the lid and box container together.

2. The rigid set up box of claim 1 further comprising coordinated decorative paper being adhered to the box container and the lid.

3. The rigid set up box of claim 1 where the box container is generally rectangular.

4. The rigid set up box of claim 1 where said ribbon extends from said first channel through said pair of side wall channels.

5. The rigid set up box of claim 1 further comprising wire reinforcement in the ribbon.

6. A method of using a rigid set up box, the rigid set up box comprising:

a lid, a box container, and a ribbon, where said ribbon is formed of a thin flexible material of a selected width and a length, where the box container is defined by a floor defining a generally flat member having an upper and a lower surface, said member having a perimeter, said member including a generally planar base member extending under the entire floor and having two insert members of a select thickness greater than the ribbon width where said insert members are affixed to the planar base member in a manner to be separated and to define a first channel corresponding to the width of the ribbon and extending across the upper surface of the planar base member and defining a selected depth corresponding to the select thickness of the inserts, an upstanding side wall portion having an interior and an exterior surface, said side wall portion projecting from the perimeter of the member and above the upper surface for a first select distance, a pair of side wall channels formed in said side wall portion and disposed oppositely each other relative to the floor, where each of said side wall channels terminate at a ribbon throughput including a ribbon opening formed in the exterior surface a second select distance less than the first select distance, where said lid defining an upper surface and a lower surface corresponding to generally planar base member combined with the upstanding side wall portion, said lid including a side wall portion defining a third distance less than the first select distance less the second select distance, said lid being adapted to seat over and on said box container, and where the ribbon is of a length sufficient to pass through the first channel, through the ribbon throughputs and over the upper surface of the lid to permit the ribbon to be secured over the lid to thereby secure the lid and box container together, the method including the steps of placing a select item in the box container, seating the lid onto the box container, and tying the ribbon over the top of the lid.

7. An improved, integrated ribbon and rigid set up box combination including a lid, a container portion with a floor, and a side wall portion projecting from the floor, the side wall portion having an exterior surface, where the improvement includes first, second, and third ribbon channels for receiving and retaining the ribbon, the first ribbon channel being formed in the floor, the second and third ribbon channels being formed in the side wall portion and disposed oppositely each other relative to the floor, where each of the second and third ribbon channels terminate at a ribbon throughput including a ribbon opening formed in the exterior surface, the second and third ribbon channels communicating with the first ribbon channel, whereby the ribbon may extend from the first ribbon channel to the second ribbon channel, to the third ribbon channel, to the lid.

8. A gift box, comprising a base, the base including a base channel formed therein and including at least a pair of ribbon feedthrough apertures, a side wall portion projecting from the base, the side wall portion having an exterior surface, a pair of side wall channels formed in the side wall portion and disposed oppositely each other relative to the base, where each of the side wall channels terminate at a ribbon throughput including a ribbon opening formed in the exterior surface of the side wall portion, lid means for conforming to the side wall portion, a ribbon means for positioning in the base channel, through the feedthrough apertures, through the side wall channels, and though the ribbon openings where the ribbon means is securable over the lid to provide an integrated gift box.

9. An integrated rigid gift box comprising a cover formed from cardboard, a base formed from cardboard including a transecting ribbon channel, and a side wall portion projecting from the base, a pair of side wall channels formed in the side wall portion and disposed oppositely each other relative to the base, where each of the side wall channels terminate at a ribbon throughput including a ribbon opening formed in the exterior surface of the side wall portion, and a ribbon extending through the ribbon channel and side wall channels, for tying over the cover when seated over the base container.

* * * * *